US007159866B2

(12) United States Patent
Selph

(10) Patent No.: US 7,159,866 B2
(45) Date of Patent: Jan. 9, 2007

(54) HIDDEN ELEMENT PUZZLE

(76) Inventor: Charles Tyler Selph, 3046 Bell Oak Rd., Williamston, MI (US) 48895

( * ) Notice: Subject to any disclaimer, the term of this patent is extended or adjusted under 35 U.S.C. 154(b) by 0 days.

(21) Appl. No.: 10/408,202

(22) Filed: Apr. 7, 2003

(65) Prior Publication Data

US 2004/0195766 A1 Oct. 7, 2004

(51) Int. Cl.
*A63F 9/06* (2006.01)

(52) U.S. Cl. ..... 273/157 R

(58) Field of Classification Search ..... 273/157 R, 273/153 R, 156; 380/54, 56; 283/70, 72, 283/73, 94

See application file for complete search history.

(56) References Cited

U.S. PATENT DOCUMENTS

| | | | | | |
|---|---|---|---|---|---|
| 1,901,989 | A | * | 3/1933 | Schwantes | 283/70 |
| 2,258,891 | A | * | 10/1941 | Harrington | 283/72 |
| 2,842,054 | A | * | 7/1958 | Monger | 283/72 |
| 3,969,830 | A | * | 7/1976 | Grasham | 380/54 |
| 4,326,665 | A | | 4/1982 | Scott | |
| 4,614,266 | A | | 9/1986 | Moorhead | |
| 4,714,275 | A | * | 12/1987 | Engel et al. | 281/15.1 |
| 5,245,815 | A | | 9/1993 | Savage | |
| 5,282,537 | A | | 2/1994 | Wong | |
| 5,409,105 | A | | 4/1995 | Appelbaum et al. | |
| 5,458,235 | A | | 10/1995 | Stone | |
| 5,497,876 | A | | 3/1996 | Fleming | |
| 5,588,526 | A | * | 12/1996 | Fantone et al. | 206/308.1 |
| 5,740,959 | A | | 4/1998 | Savage | |
| 5,769,227 | A | | 6/1998 | Fantone | |
| 5,775,494 | A | | 7/1998 | Taplin | |
| 5,782,347 | A | | 7/1998 | Fantone et al. | |
| 5,823,344 | A | | 10/1998 | Fantone et al. | |
| D412,784 | S | | 8/1999 | Richardson | |
| D415,419 | S | | 10/1999 | Abiteboul | |
| 6,062,978 | A | | 5/2000 | Martino et al. | |
| 6,070,719 | A | | 6/2000 | Pollock | |
| 6,112,442 | A | | 9/2000 | Liang | |
| 6,202,838 | B1 | | 3/2001 | Tran | |
| 6,220,443 | B1 | | 4/2001 | Damaskos | |
| 6,296,281 | B1 | * | 10/2001 | Stone | 283/93 |
| 6,382,625 | B1 | | 5/2002 | Chang | |
| 6,406,062 | B1 | | 6/2002 | Brooks et al. | |
| 6,422,388 | B1 | | 7/2002 | McCahey | |
| 6,435,502 | B1 | | 8/2002 | Matos | |
| 6,547,243 | B1 | * | 4/2003 | Juenger | 273/157 R |
| 6,634,644 | B1 | * | 10/2003 | Falana | 273/157 A |
| 2003/0000862 | A1 | | 1/2003 | Matushek | |
| 2003/0006152 | A1 | | 1/2003 | So | |
| 2003/0006165 | A1 | | 1/2003 | Evans et al. | |

* cited by examiner

*Primary Examiner*—Steven Wong
(74) *Attorney, Agent, or Firm*—John M. Naber; Dickinson Wright PLLC

(57) ABSTRACT

A substantially hidden element puzzle capable of being incorporated in a variety of structures such as gift or product containers and greeting cards includes at least one substantially flat surface having an image thereon. The image includes at least one elongated element that is only legible when the substantially flat surface is positioned at a selected distance and angle relative to the user. The hidden element puzzle may also include superimposed elongated elements on one or more flat surfaces of the structure for which it is incorporated.

1 Claim, 14 Drawing Sheets

HIDDEN ELEMENT PUZZLE

BACKGROUND OF THE INVENTION

1. Field of the Invention

The present invention generally relates to a puzzle and particularly to a puzzle having hidden elements that can be incorporated into many different objects or structural configurations, including gift containers and greeting cards.

2. Discussion of the Prior Art

There are many types of puzzles and games known in the art designed to challenge the user and provide entertainment. Many of these puzzles and games are designed with a specific configuration for a specific structure. Thus, a puzzle configured to be included on several different types of products or structures is desirable.

There are also many different types of gift boxes and containers known in the art that provide various visual and entertaining attributes. Many of these types of gift containers generally vary in their visual appearance depending on the desired aesthetics of the consumer.

Some containers are configured to store an object throughout the life of the object, such as the container for a compact disc. These containers may also include texts or graphics on the package to identify the product or gift inside. Other gift packages may include a card and box combination, where text and/or graphics are displayed on a card that is integral with or attached to the gift box. While there are many types of gift and product containers, most of these types function solely as a means of concealing the gift or storing the product. Once the gift or product is opened, the container is typically discarded.

There are also various types of greeting cards known in the art having various aesthetic and physical attributes. Some of these cards include texts, pictorials, musical capabilities, and a variety of other features.

Thus, there is a desire and need in the art to provide a hidden element puzzle that can be combined with many different items, such as gift or product containers and greeting cards. It would be further desirable to provide a hidden element puzzle having entertaining hidden graphics or texts to further add to the value and function of items such as gift or product containers, greeting cards, and business logo cards and paraphernalia.

SUMMARY OF THE INVENTION

Accordingly, the present invention provides a hidden element puzzle capable of incorporation into many different suitable products.

In one embodiment of the present invention, a hidden element puzzle includes at least one substantially flat surface and an image on the at least one substantially flat surface. The image includes at least one elongated element that is only legible when the substantially flat surface is positioned at a selected distance and angle relative to the user.

In another embodiment of the present invention a hidden element puzzle container combination includes a structure having a plurality of substantially flat walls defining an interior space. The structure is configured to conceal an object and at least one of the substantially flat walls includes an image having at least one elongated element. The at least one elongated element is only legible when the at least one substantially flat wall is positioned at a selected distance and angle relative to the user.

In yet another embodiment of the present invention a puzzle container combination includes a structure having a plurality of substantially flat walls that define an interior space and at least one of the walls is transparent. An insert having at least one section and an image on the at least one section is removably inserted into the interior space so that the image is positioned substantially parallel to the at least one transparent wall. The image is legible only when the structure is positioned at a selected angle and distance relative to the user.

In still another embodiment of the present invention a puzzle greeting card combination includes a greeting card having at least one substantially flat side and an image on the at least one substantially flat side. The image includes at least one elongated element and the at least one elongated element is only legible when the at least one substantially flat side is positioned at a selected angle and distance relative to the user.

Other features of the present invention will become more apparent to persons having ordinary skill in the art to which the present invention pertains from the following description and claims taken in conjunction with the accompanying figures.

BRIEF DESCRIPTION OF THE FIGURES

The foregoing features, as well as other features, will become apparent with reference to the description and figures below, in which like numerals represent like elements, and in which.

DETAILED DESCRIPTION OF THE INVENTION

The present invention generally relates to a substantially hidden element puzzle that may be incorporated into a variety of structures such as gift or product containers and greeting cards.

Figure 1:
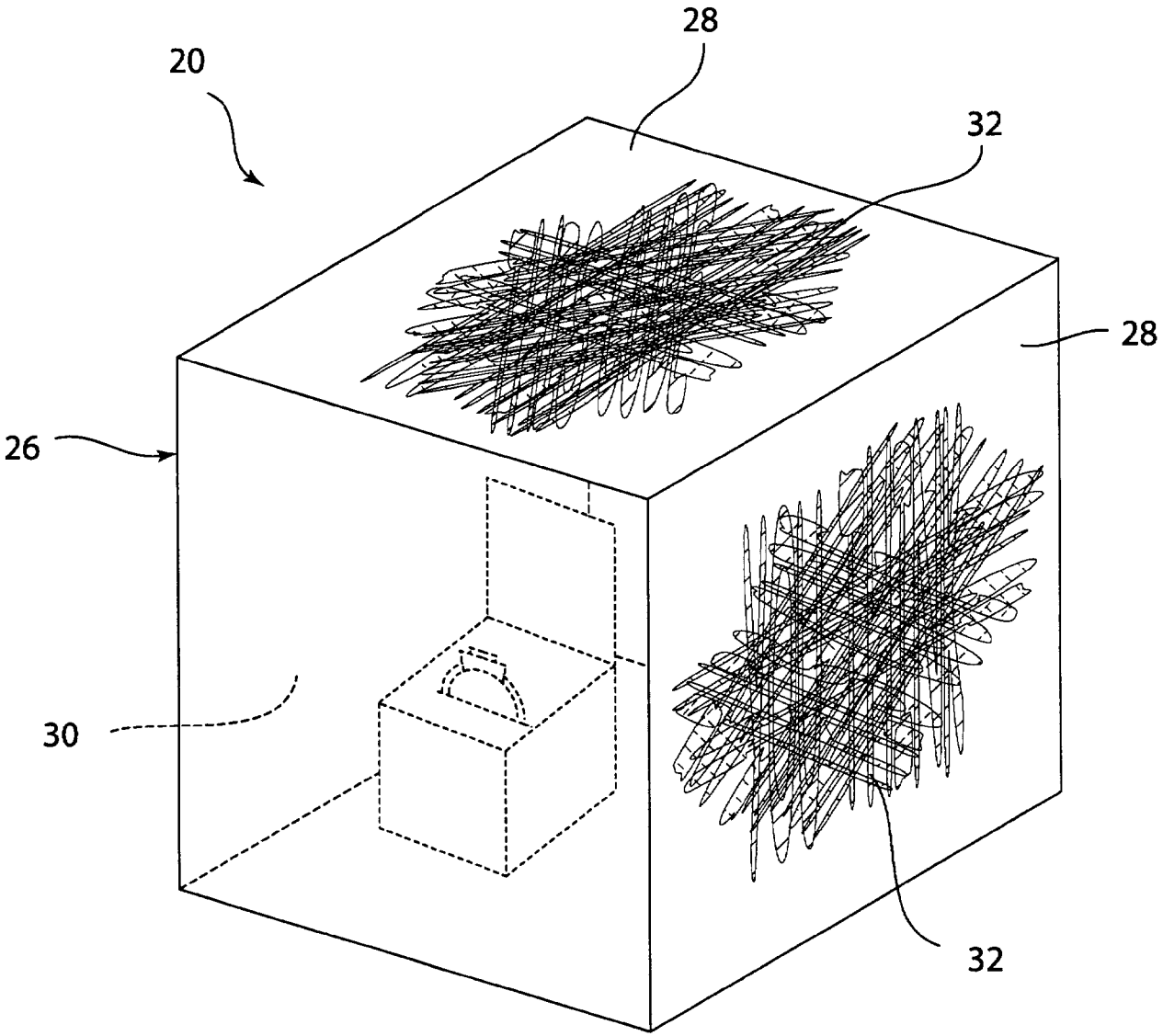
FIG. 1 is a perspective view of one embodiment of the puzzle of the present invention.

Referring to FIG. 1, a hidden element puzzle of the present invention can be incorporated into a variety of structural configurations such as a gift or product container 20 ("container") having at least one substantially flat side.

Figure 2:
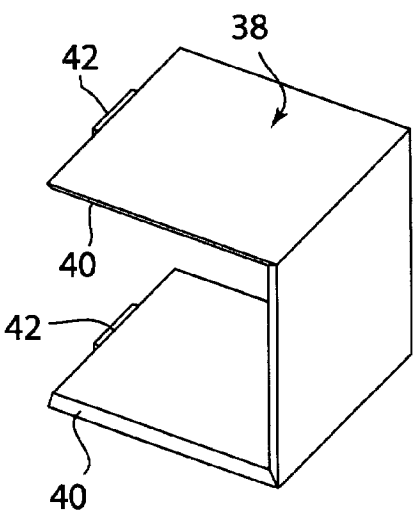
FIG. 2 is a perspective view of an embodiment of a structure of the present invention.
Figure 2:
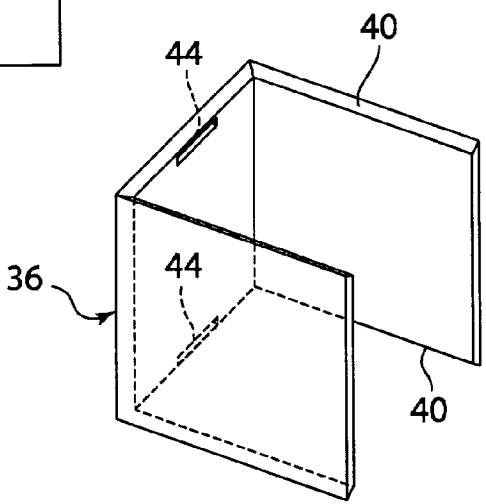

As shown in FIG. 1, by way of example, container 20 may include a structure 26 having a plurality of substantially flat sides or walls 28 that define an interior space 30 capable of storing or concealing an object, and an image 32 on at least one of the plurality of walls 28. Structure 26 may be made of a transparent material such as a clear plastic material, or alternatively, structure 26 may be made of cardboard or any other suitable material known in the art. In one embodiment, structure 26 may be a collapsible cardboard box known in the art as shown in FIG. 1. In another embodiment, structure 26 may include a first and second mating member 36 and 38 as shown in FIG. 2. In the embodiment of FIG. 2, mating members 36 and 38 have mating chamfered edges 40 to enable them to be slidably connected. One of first and second mating members 36 and 38 may also include at least one lip 42 that is inserted into at least one slot 44 on the other of mating members 36 and 38 to further hold together members 36 and 38. Alternatively, members 36 and 38 may be configured to frictionally fit together.

Figure 3:
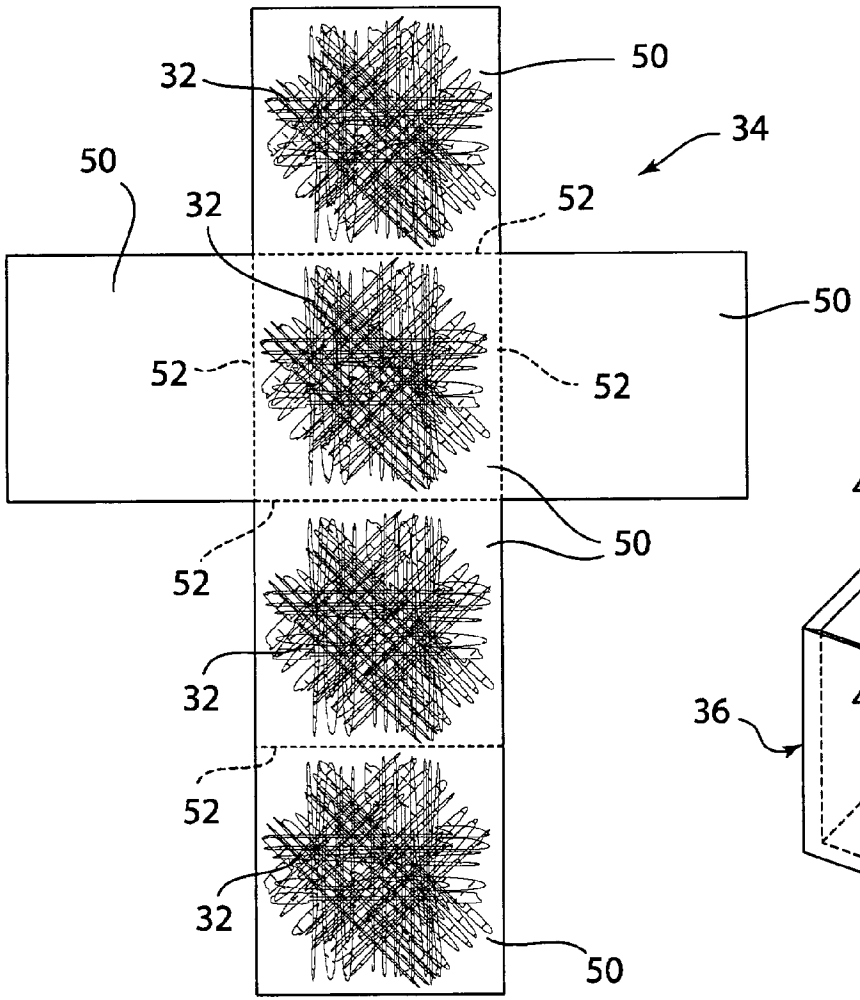
FIG. 3 is an unfolded view of an embodiment of an insert of the present invention.

The image 32 includes elongated texts (not language specific) or graphics to create a substantially hidden element and may be affixed to a substantially flat surface to create the hidden puzzle of the present invention. Elongated, as illustrated in the figures and as commonly known in the art, refers to the stretching of texts, images, or other indicia so that its form is longer relative to its width to the point that it is distorted beyond recognition unless it is viewed at an angle. As viewing angle increases the indicia it becomes visible as its length is more relative to its width to the point that it is recognizable. This elongated aspect is most evident in FIG. 4*b*, which is elongated to form the image of 4*a*. In use, indicia, such as image 32 (such as shown in FIG. 2), are elongated to the point that they are distorted when viewed directly. Thus the significance of the elongation is not merely aesthetic. Image 32 may be affixed to the surface by means known in the art such as printing or painting on. In one embodiment, image 32 may be affixed to an insert 34 as shown in FIG. 3. Alternatively, image 32 may be affixed directly to one of the plurality of substantially flat walls 28 as shown in FIG. 1. In addition, image 32 can be hand generated or computer generated using software.

As shown in FIG. 3, insert 34 may include image 32 included on one or more sections 50 and may be configured such that it is capable of being folded into a desired shape of the particular puzzle configuration. For purposes of illustration, an insert 34 for a six-sided structure is shown in FIG. 3. However, it should be recognized that an insert having any number of sides could also be utilized to practice the present invention.

Insert 34 may include fold lines 52 indicating the proper location to fold insert 34. Fold lines 52 may include a painted or printed line or a scored or scribed line, all of which are known in the art. Once folded as desired, insert 34 can be positioned in interior space 30 of container 20, such that sections 50 of insert 34 are substantially parallel and contacting walls 28. Further, insert 34 may be constructed of paper or other suitable material for printing image 32 thereon. In order for image 32 on insert 34 to be viewed in this embodiment, structure 26 must include at least one clear or transparent wall 28. Image 32 may then be viewed through wall 28 of structure 26.

Figure 4A:
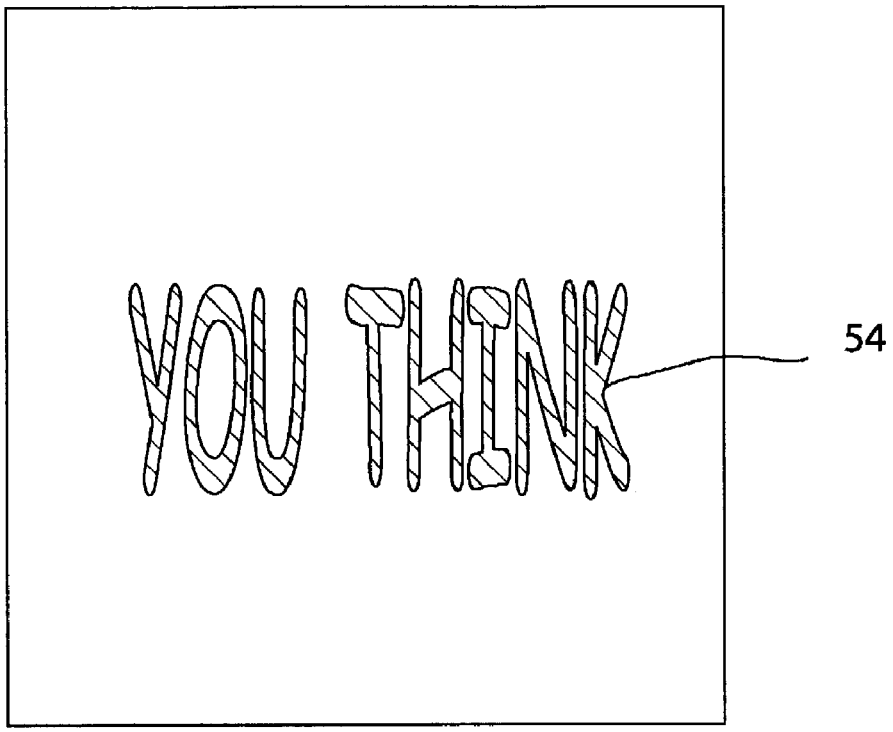
FIG. 4A–4H is an illustration of the progression of creating elongated elements of the present invention.
Figure 4B:
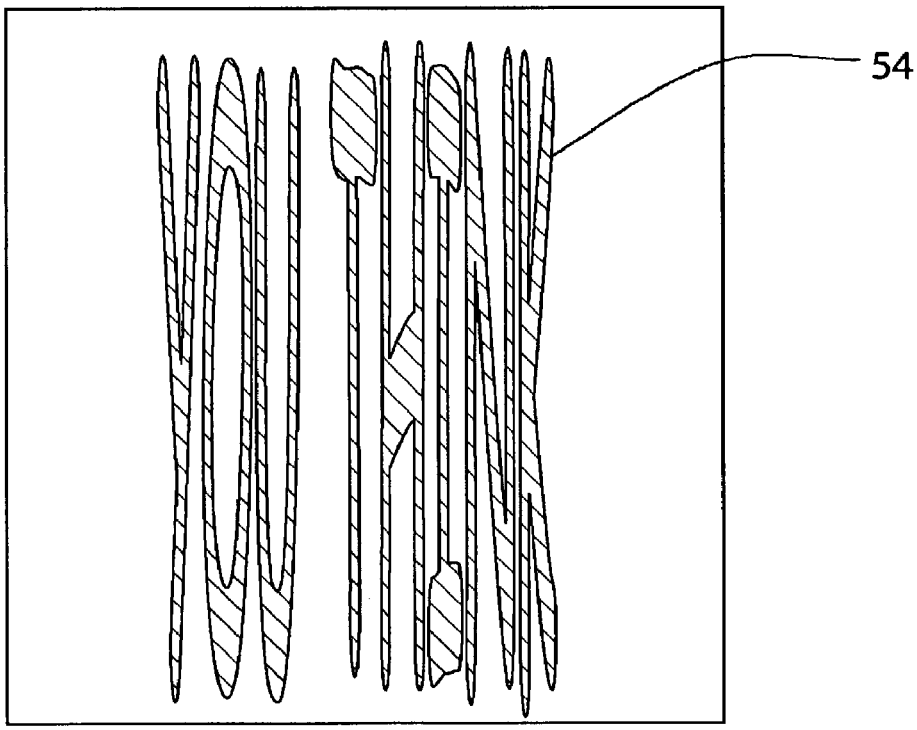
Figure 4C:
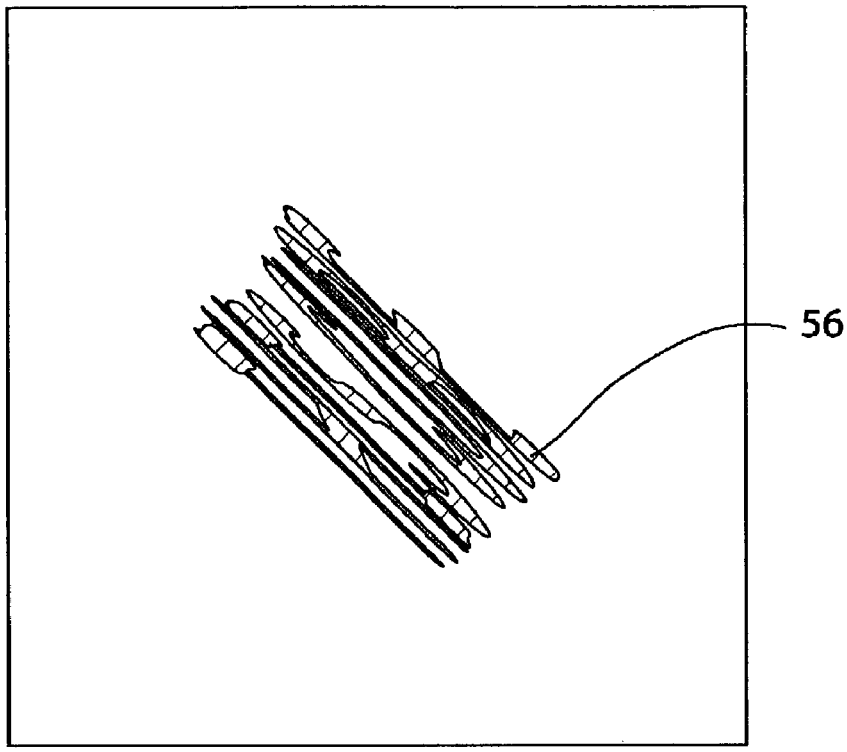
Figure 4D:
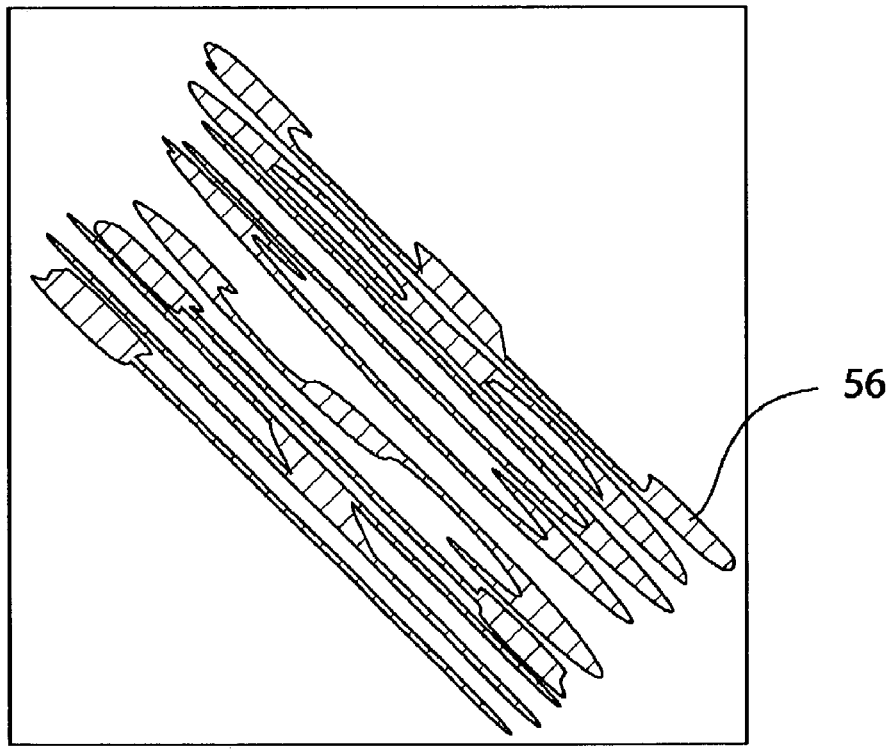
Figure 4E:
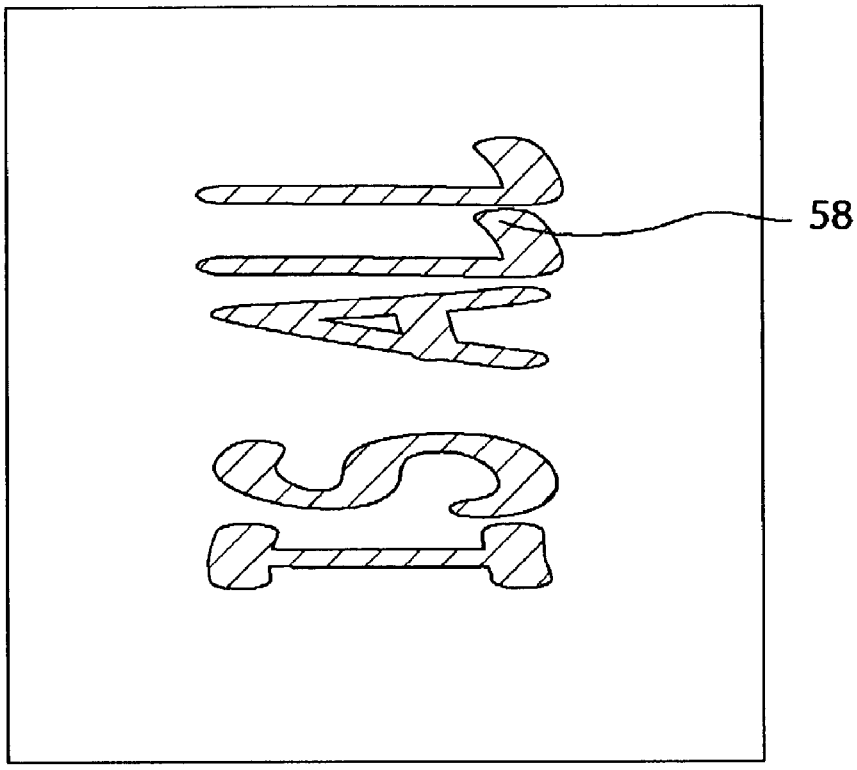
Figure 4F:
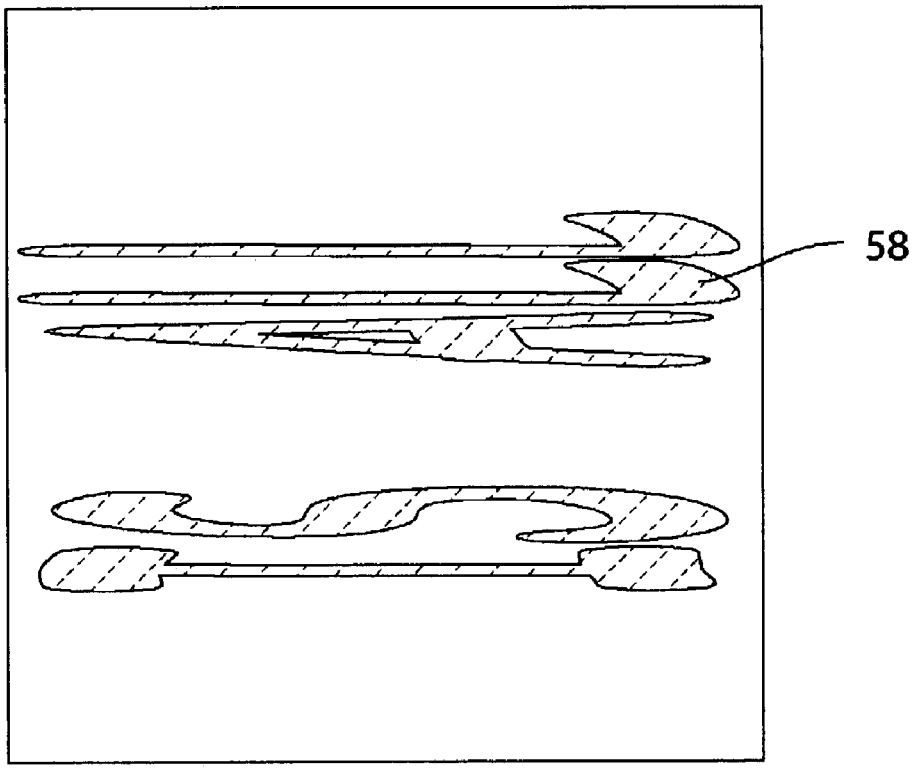
Figure 4G:
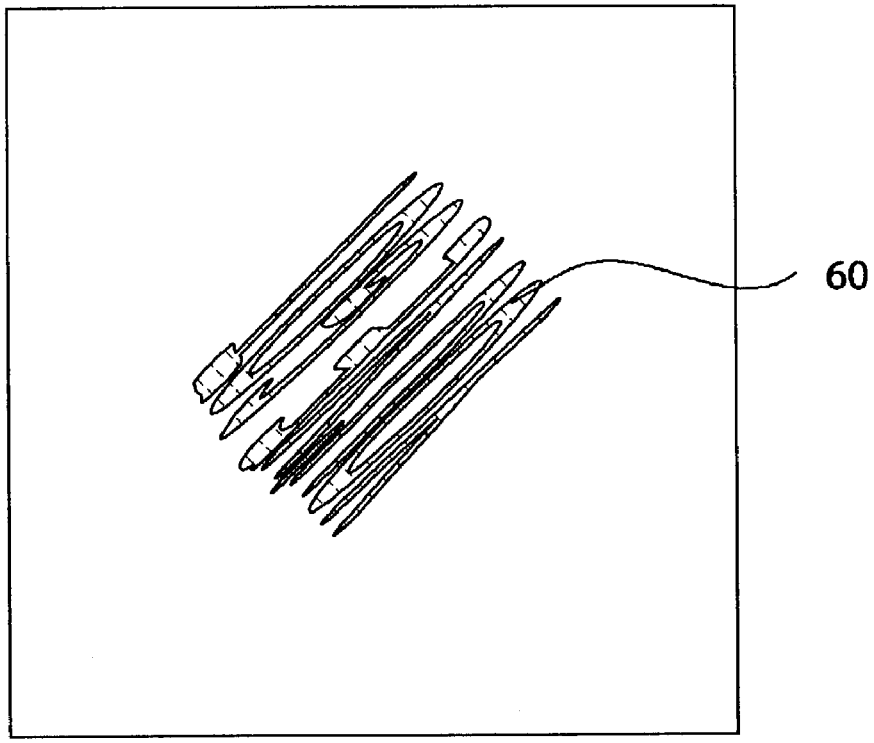
Figure 4H:
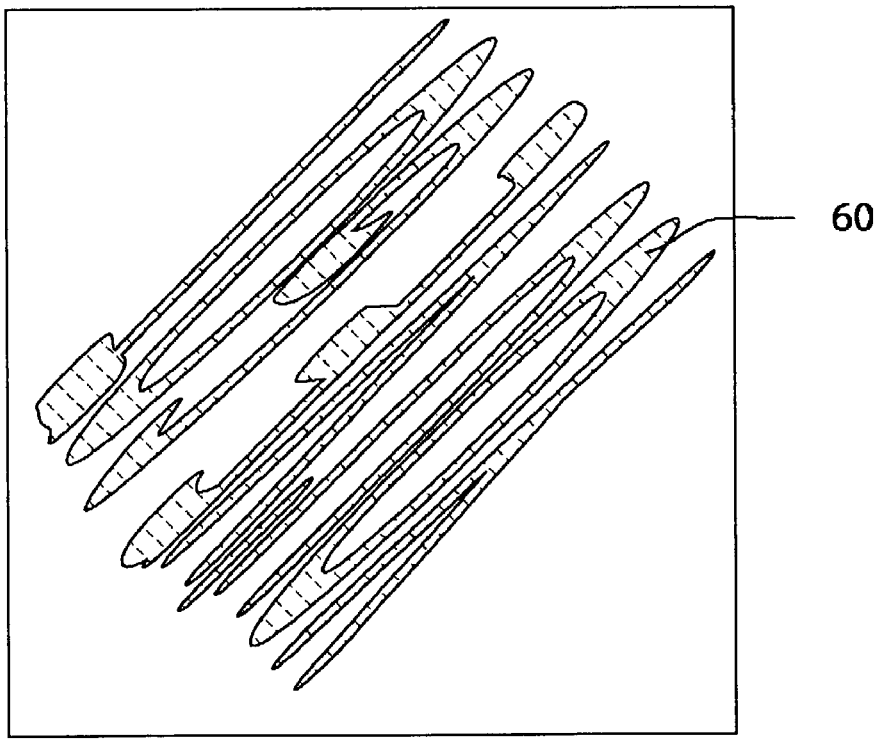
Figure 5A:
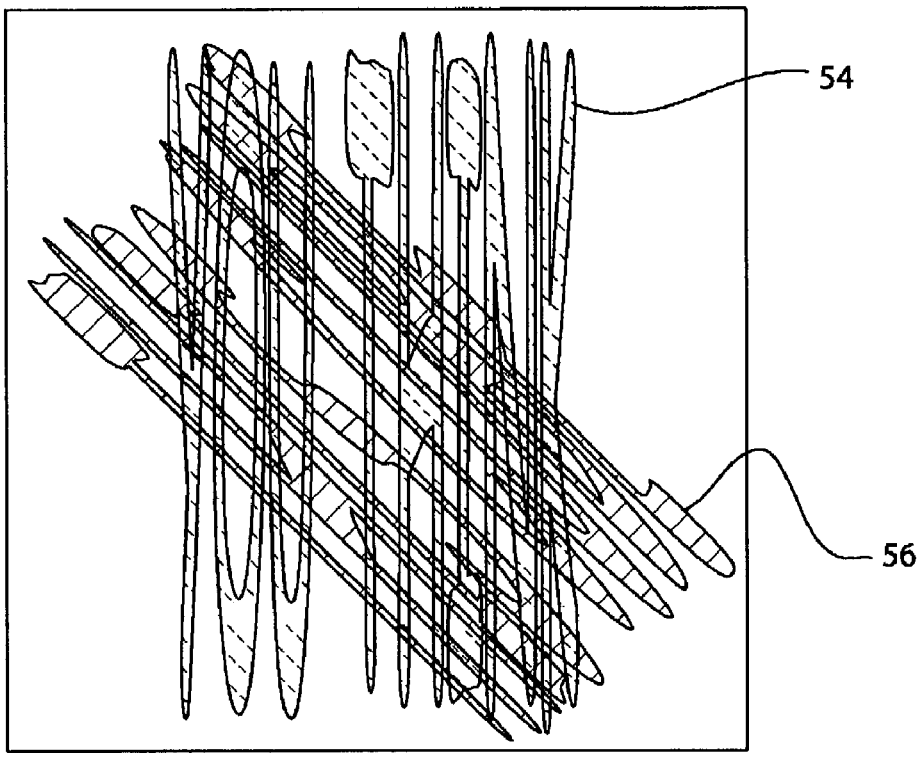
FIG. 5A–5C is an illustration of the progression of superimposing elements of the present invention.
Figure 5B:
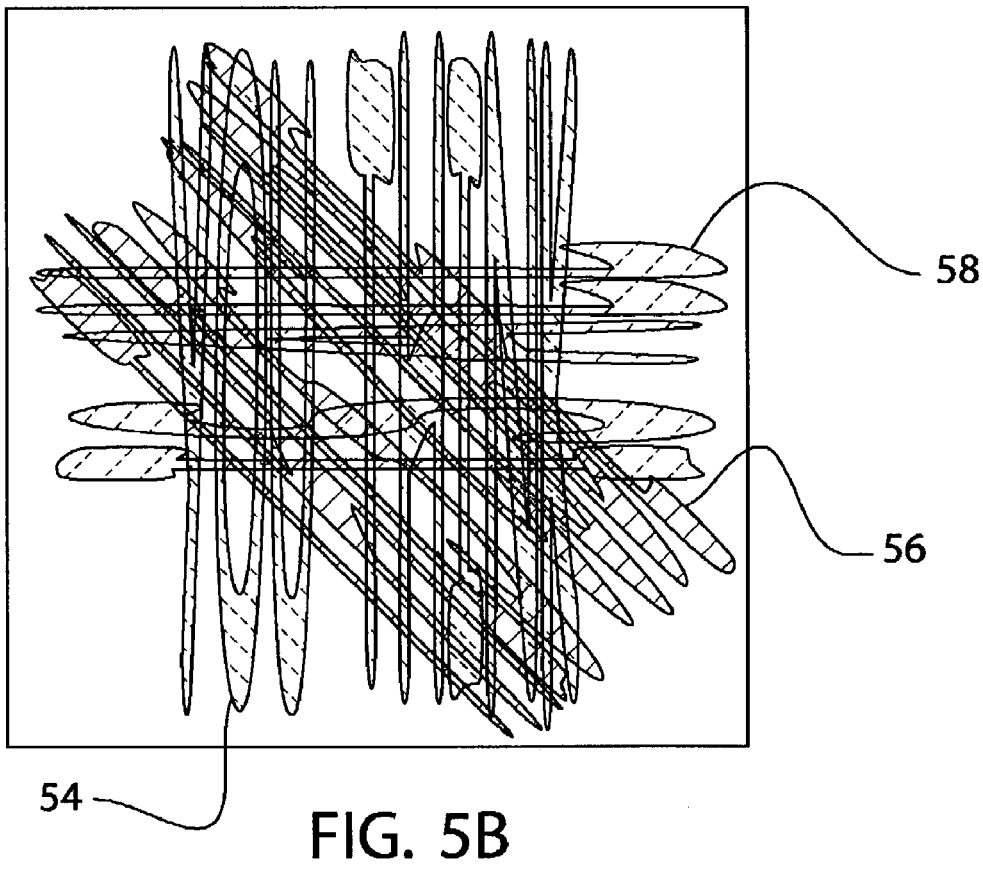
Figure 5C:
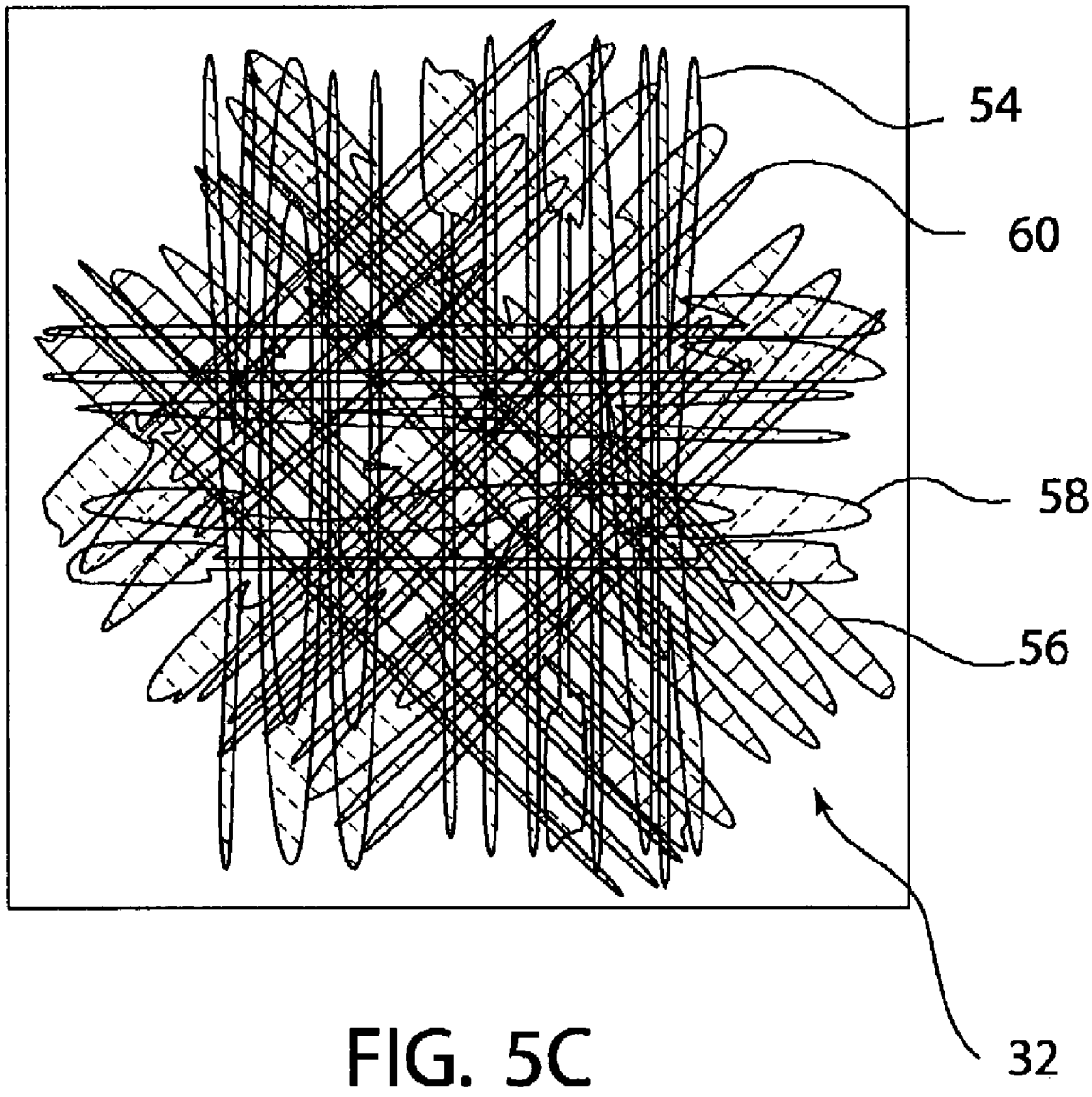
Figure 11:
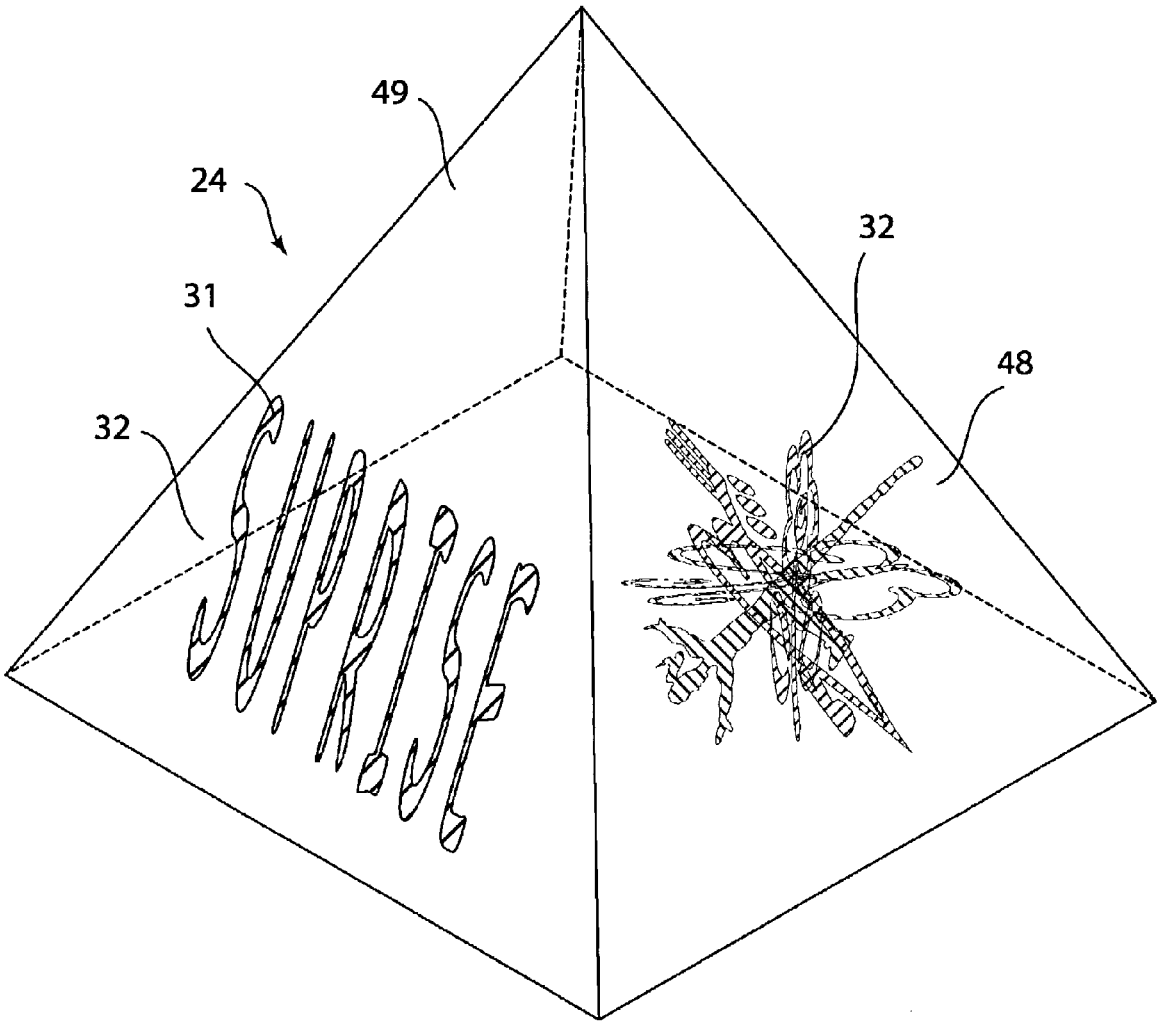
FIG. 11 is a perspective view of another embodiment of the puzzle of the present invention.

To better understand the creation of image 32, FIGS. 4A–4H illustrate elongating text or graphics, and FIGS. 5A–5C illustrate superimposing text or graphical designs to create the hidden elements of image 32. For illustration purposes, the creation of image 32 having four superimposed elements will be described. It is to be understood by those skilled in the art that the number and content of superimposed layers may vary from this illustration. A single elongated element could be used as the hidden element puzzle of this invention if text or graphics are elongated sufficiently to disguise their appearance at first glance by the user. For example, FIG. 11 illustrates image 32 comprised of a single element 31 on substantially flat surface 49 that includes texts to create the word "surprise." Alternatively, also shown in FIG. 11, image 32 may be comprised of graphical elements.

In FIG. 4A a first element 54 is created by drawing or computer generating element 54 and then elongating it as shown in FIG. 4B. A second element 56 is then generated in the same manner but at a different angle relative to the first element 54 as shown in FIG. 4C. Second element 56 is then elongated as shown in FIG. 4D. A third element 58 is created at yet another angle relative to the other elements 54 and 56 as shown in FIG. 4E, and elongated as shown in FIG. 4F. A fourth element 60 is created at still another angle relative to the other elements 54–58 as shown in FIG. 4G, and elongated as shown in FIG. 4H.

The four elements 54–60 may then be superimposed to create, in combination, image 32. FIGS. 5A–5C further illustrate the present invention by showing the progression of superimposing elements 54–60. FIG. 5A shows second element 56 superimposed over first element 54. FIG. 5B shows third element 58 superimposed over second element 56 and first element 54, and FIG. 5C shows fourth element 60 superimposed over third element 58, second element 56 and first element 54, the combination of which creates image 32.

Figure 6:
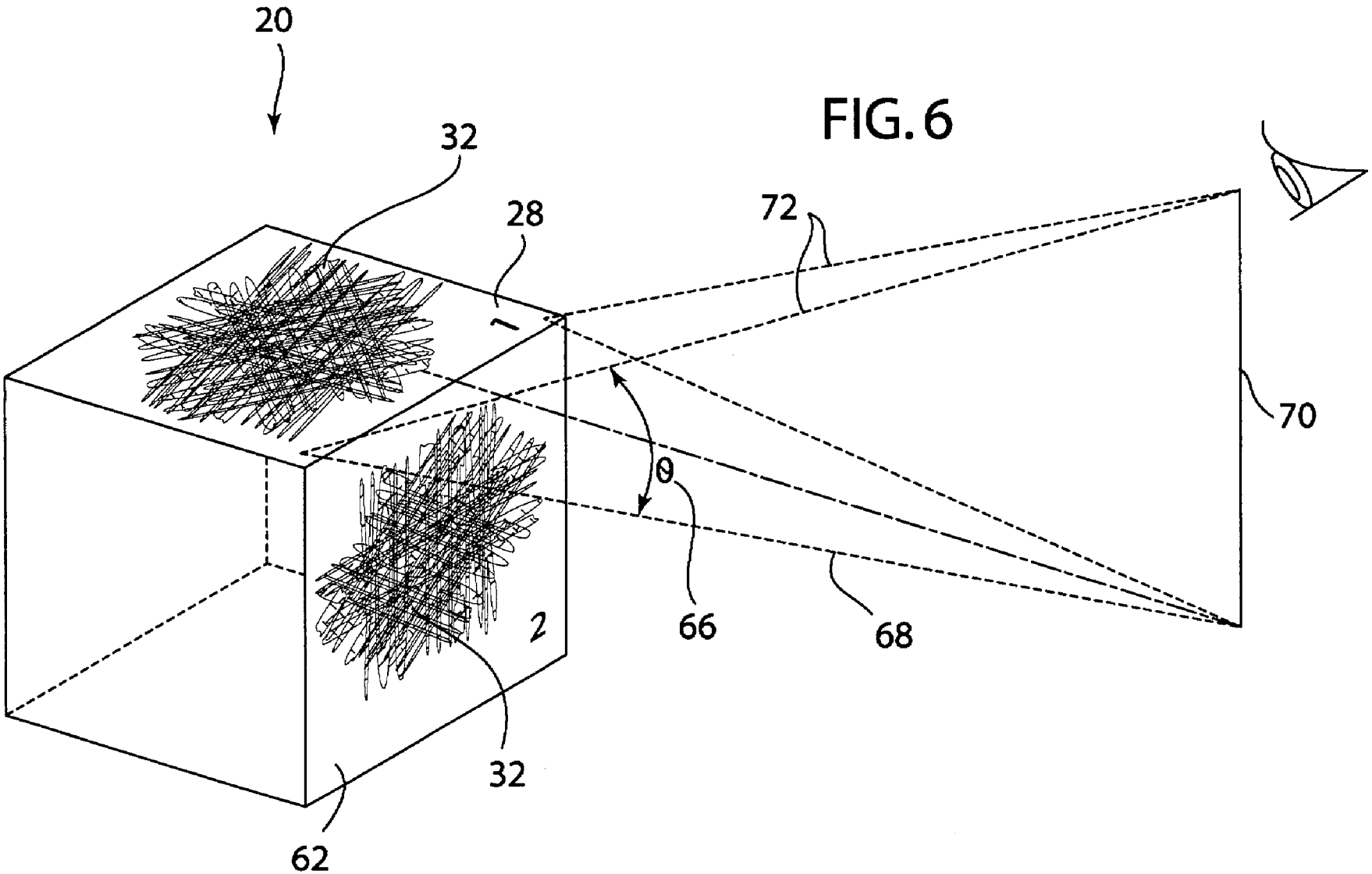
FIG. 6 is a perspective view of an embodiment of the present invention as viewed from the user at an angle and distance such that a given element is not legible.

By way of further example, FIG. 6 illustrates the superimposed elongated hidden elements of image 32 incorporated on a substantially flat surface such as surface 28 of container 20. In FIG. 6, surface 28 is viewed from an angle such that the individual elements 54–60 of image 32 are not legible. The legibility of a given element 54–60 of image 32 is dependent upon such factors as a horizontal distance 68 and a vertical distance 70 between container 20 and the user, and an angle 66 created between the line of sight 72 of the user and the plane for which image 32 is contained. The closer container 20 is positioned relative to the user (or smaller distance 68 is), the smaller angle 66 must be to view one of elements 54–60 (and therefore, the smaller distance 70 must be). Thus, as angle 66 becomes closer to ninety degrees, container 20 must be further from the user (or a greater distance 68) to view one of the elements 54–60 in a readable form.

Figure 7:
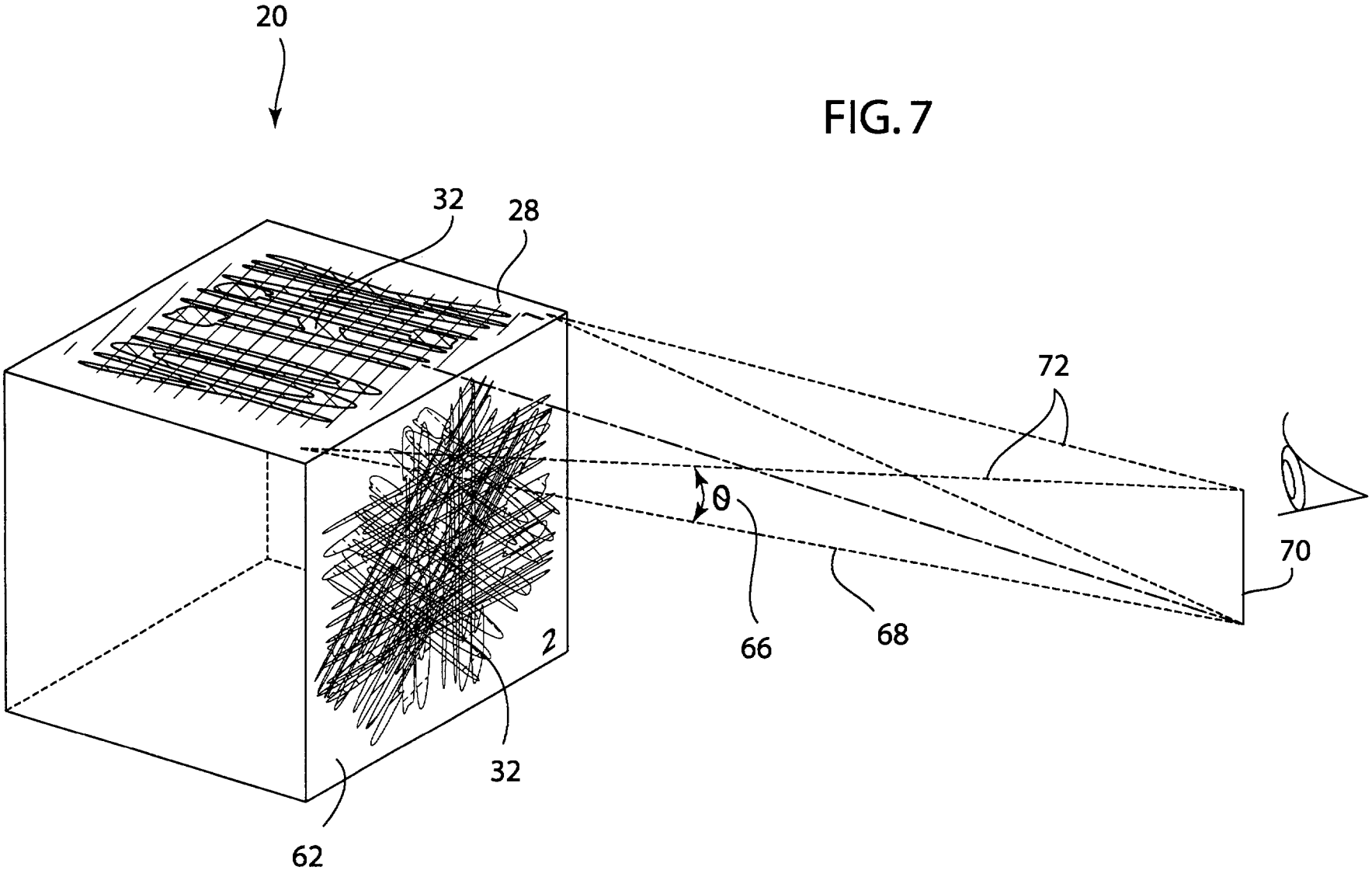
FIG. 7 is a perspective view of an embodiment of the present invention as viewed from a user at the same distance and different angle than as in FIG. 6 such that a given element is legible.
Figure 8:
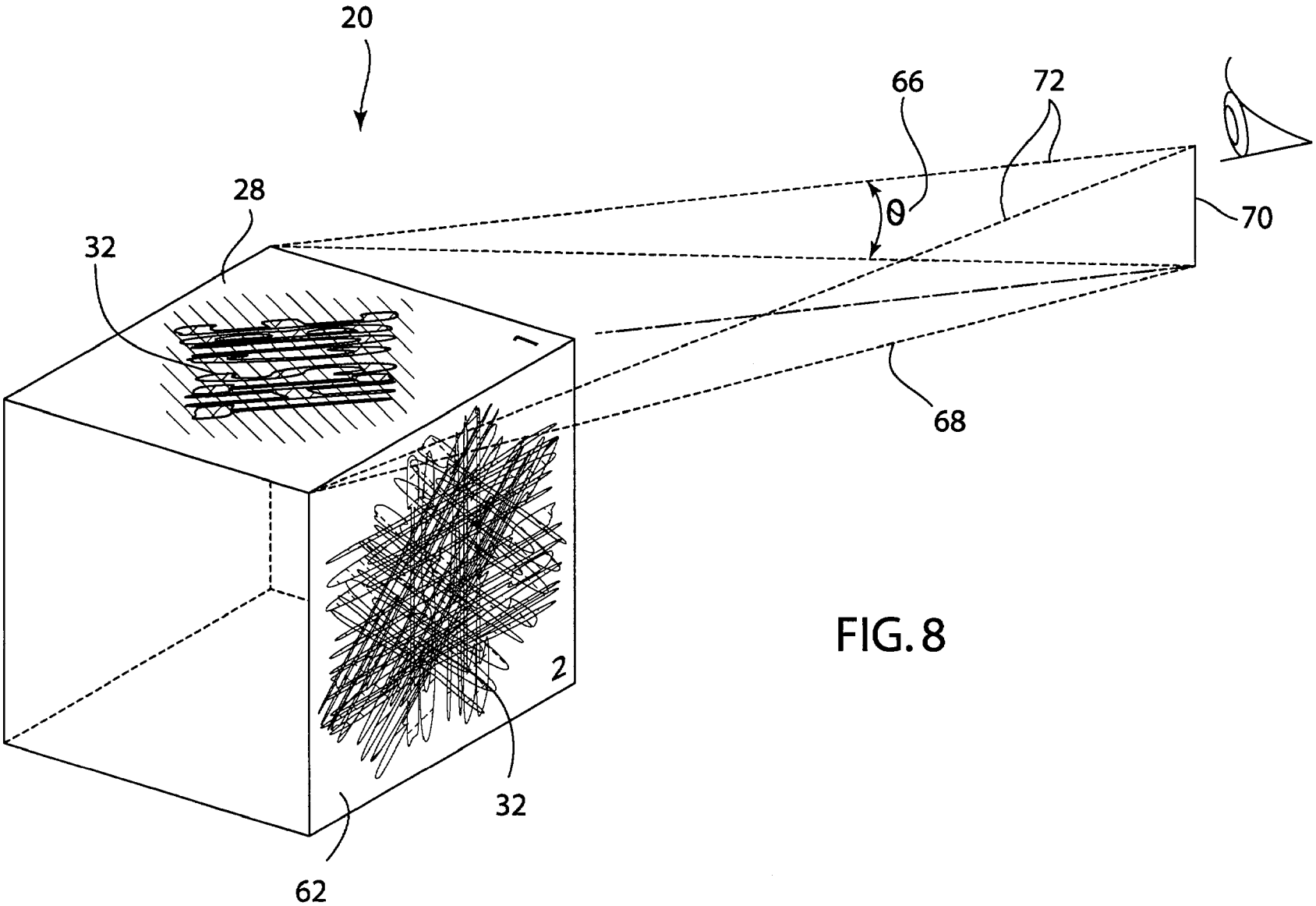
FIG. 8 is a perspective view of the embodiment in FIG. 7 rotated 45 degrees counterclockwise such that a different element is now legible.

FIG. 7 illustrates container 20 positioned at the same distance 68 from the user, but a smaller distance 70, creating an angle 66 closer to zero degrees. From this angle, one of elements 54–60 should be revealed to the user. To view the remainder of elements 54–60, the user may rotate container 20 either clockwise or counterclockwise about an axis perpendicular to the flat surface 28, while maintaining the angle 66 and distances 68 and 70 that allowed legibility of the first of elements 54–60. This is illustrated in FIG. 8 where container 20 is rotated 45 degrees counterclockwise relative to its position as shown in FIG. 7. This process of rotating container 20 may be repeated until all of the elements 54–60 on a given surface are in turn legible, and the hidden puzzle is revealed.

Figure 9:
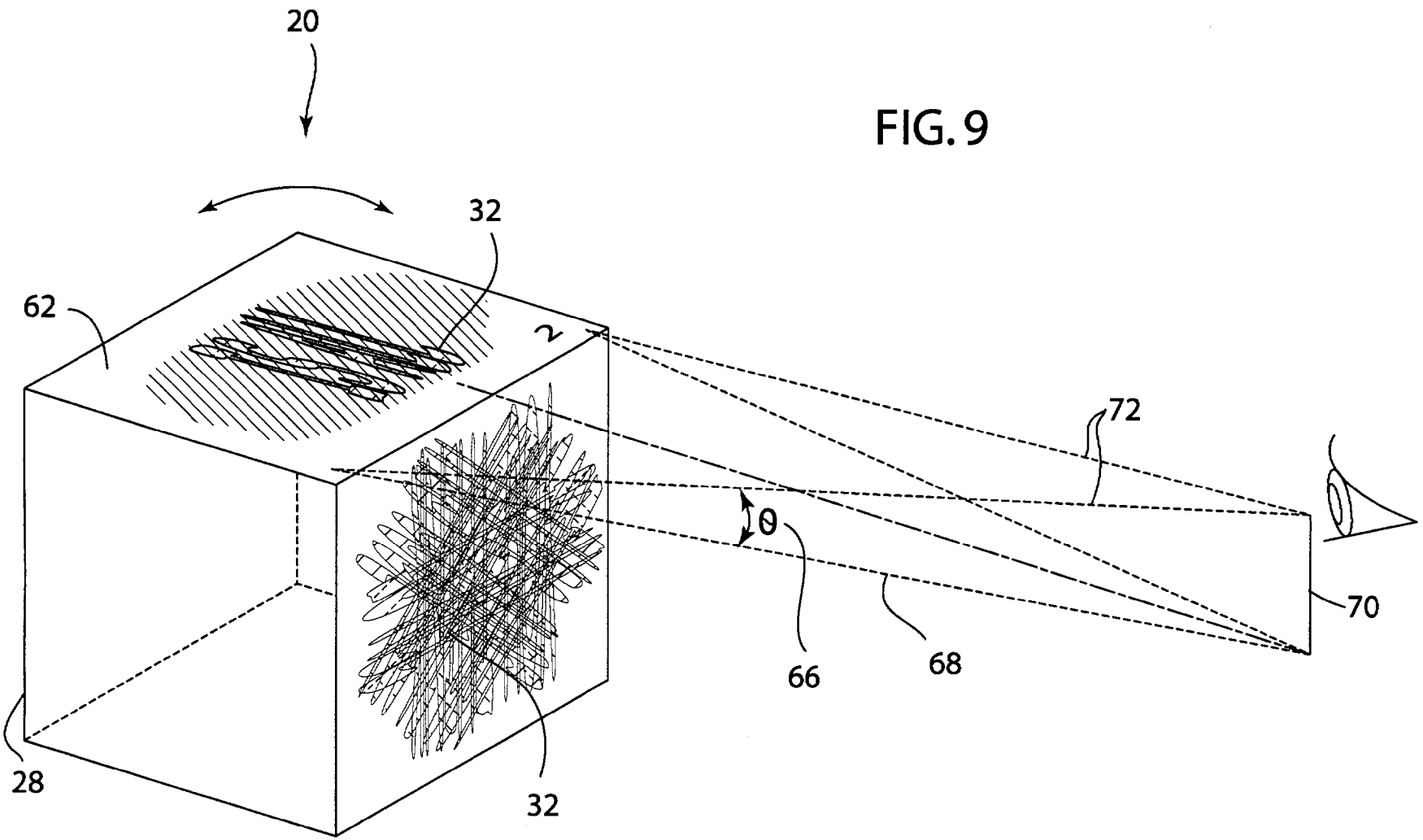
FIG. 9 is a perspective view of the embodiment of the present invention shown in FIGS. 7 & 8 rotated such that a different side is now in the viewing position.

The elongated text or graphics of image 32 may include a message that the user may decode by orienting the hidden element puzzle as described above. Further, a given structure may include image 32 on more than one substantially flat surface, and provide a puzzle that runs from one surface to another. In the example embodiment shown in FIGS. 6–9, image 32 is placed on more than one surface. To view the hidden elements on a second surface 62, the user must rotate container 20 so the plane of second surface 62 is positioned at a proper angle 66 and distances 68 and 70 to allow revealing of the hidden element as shown in FIG. 9. Second surface 62 may contain a different image 32 that can now be viewed to reveal one of the hidden elements 54–60. The user can repeat the steps of rotating container 20 clockwise or counterclockwise as illustrated in FIGS. 7 and 8, to view any superimposed elements 54–60 on second surface 62.

Many different styles and types of hidden element puzzles may be designed having a variety of different images 32 incorporated thereon. In one embodiment, shown in FIG. 1, the user can place an item, such as a product or gift in interior space 30. As a product container, the manufacturer or distributor of the item could create hidden elements to add to the overall appeal of the product packaging. As a gift box, many styles and types may be pre-designed to give consumers a variety of container 20 from which to select. Insert 34 may also be sold separately from structure 26 to enable structure 26 to be re-used with different inserts 34 having different images 32.

Figure 10:
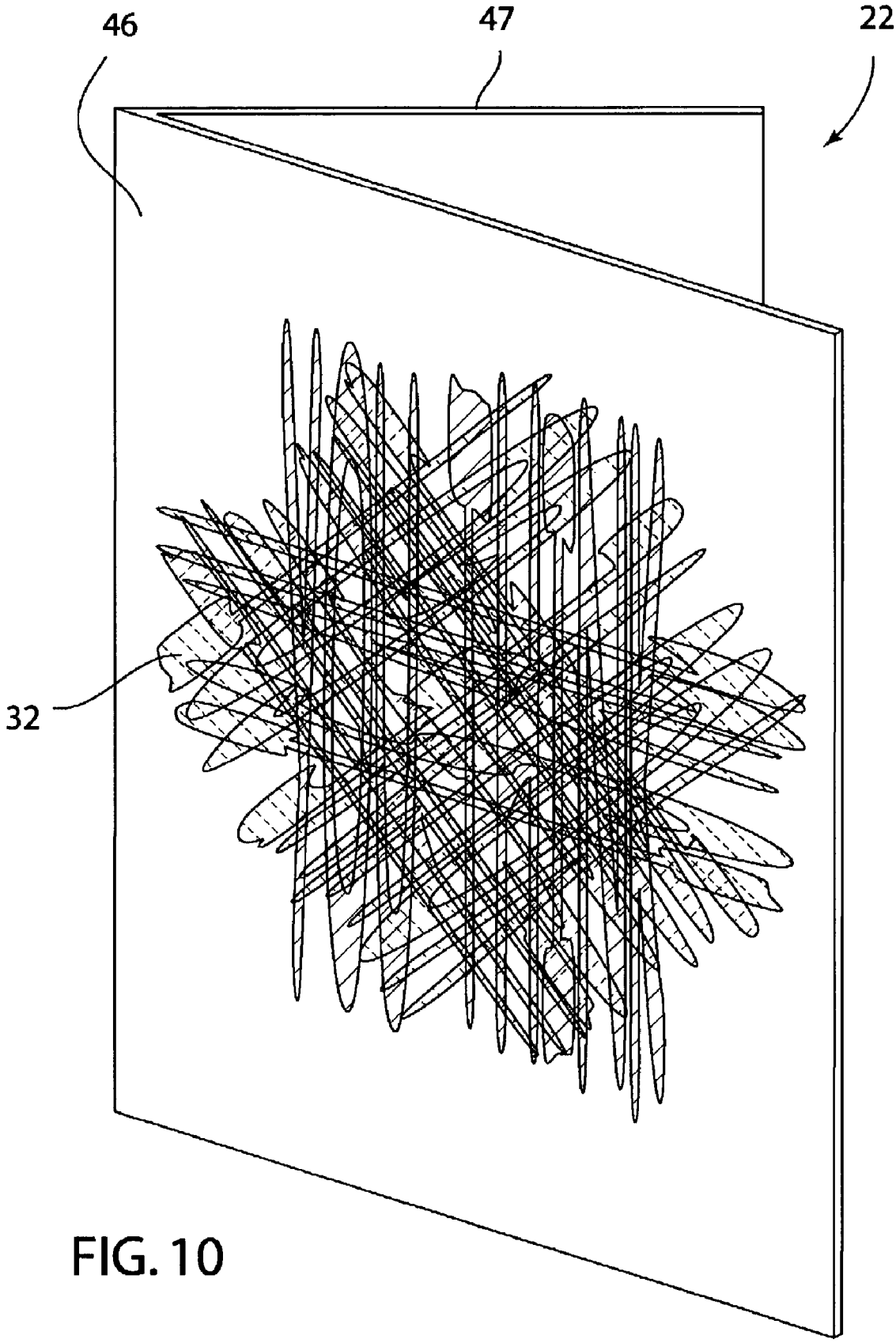
FIG. 10 is a front perspective view of another embodiment of the puzzle of the present invention.

In another embodiment of the present invention as shown in FIG. 10, a greeting card 22 may include at least one substantially flat side 46 having an image 32 that includes elongated and/or superimposed and elongated texts or graphics creating a hidden element puzzle. Greeting card 22 may be various sizes, shapes and colors and may include image 32 having any variety of hidden elements to meet the particular occasion and need of the user. Greeting card 22 may include image 32 on more than one side 46 and the hidden elements within image 32 may continue from one side 46 to another side 47.

In yet another embodiment of the present invention as shown in FIG. 11, an object 24 having any shape or configuration may contain image 32 as long as it has at least one substantially flat surface 48 to place image 32. As with container 20, object 24 may include image 32 on more than one surface such as surfaces 48 and 49 on FIG. 11, and the hidden element puzzle may include a message or design that continues from one surface to another. The hidden element puzzle of the present invention may also include solution instructions to instruct the user on how to rotate the particular structure and reveal the hidden design contained in image 32 as described within this application. Instructions may be included on a separate component such as a paper document and placed inside or on container 20, or object 24. Alternatively, instructions may be included virtually anywhere directly on the exterior of the particular structure. To further assist the user, the flat surfaces may contain a sequence of numbers to direct the user to the next surface to view, as shown by the numbers 1 and 2 on surfaces 28 and 62 respectively in FIGS. 6–9.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A hidden element puzzle comprising:

at least one substantially flat surface;

an image on said at least one substantially flat surface;

wherein said image includes at least one elongated element that is only legible when said at least one substantially flat surface is positioned at a selected range of distances and angles relative to a user, further wherein said image includes superimposed elongated elements on top of each other on the same substantially flat surface and create an image for viewing by the user;

wherein said at least one substantially flat surface includes at least two substantially flat surfaces, said at least two substantially flat surfaces including an image; and wherein said images include a message extending from one of said at least two substantially flat surfaces to the other of said at least two substantially flat surfaces.

* * * * *